US007532852B2

(12) United States Patent
Youn

(10) Patent No.: US 7,532,852 B2
(45) Date of Patent: May 12, 2009

(54) REGISTRATION DEVICE AND IMAGE FORMING APPARATUS WITH THE SAME

(75) Inventor: Karp-Sik Youn, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 483 days.

(21) Appl. No.: 11/274,206

(22) Filed: Nov. 16, 2005

(65) Prior Publication Data

US 2006/0221163 A1 Oct. 5, 2006

(30) Foreign Application Priority Data

Apr. 4, 2005 (KR) ..... 10-2005-0028070

(51) Int. Cl.
*G03G 15/00* (2006.01)

(52) U.S. Cl. ..... 399/395; 399/394

(58) Field of Classification Search ..... 399/395, 399/394; *B41J 13/00, 11/00, 25/304*
See application file for complete search history.

(56) References Cited

U.S. PATENT DOCUMENTS 5,172,138 A * 12/1992 Okazawa et al. ..... 346/134
6,011,948 A * 1/2000 Amano et al. ..... 399/395
6,189,991 B1 * 2/2001 Wen et al. ..... 347/13
6,530,704 B2 * 3/2003 Omura ..... 400/58
6,666,600 B1 * 12/2003 Shirota et al. ..... 400/579
7,249,903 B2 * 7/2007 Shaw, III ..... 400/621
7,308,227 B2 * 12/2007 Ahn ..... 399/388

FOREIGN PATENT DOCUMENTS

| | | |
|---|---|---|
| JP | 08-002043 | 1/1996 |
| JP | 08-324834 | 12/1996 |
| JP | 10-086385 | 4/1998 |
| JP | 10-202971 | 8/1998 |
| JP | 2003-054788 | 2/2003 |
| KR | 2004-0110501 | 12/2004 |
| WO | WO 03/004279 A1 * | 1/2003 |

OTHER PUBLICATIONS

WO 03/004279 A1 is attached.*

* cited by examiner

*Primary Examiner*—Anthony H. Nguyen
(74) *Attorney, Agent, or Firm*—Roylance, Abrams, Berdo & Goodman, L.L.P.

(57) ABSTRACT

A registration device includes a feed roller which presses one surface of a sheet to feed the sheet. A cartridge unit is placed opposite to the feed roller and includes a follower roller to support the other surface of the sheet. An image forming unit forms an image on the sheet and a regulating element rotates the cartridge unit relative to the feed roller so that an arranged sheet can be fed into the image forming unit. The registration device can regulate the parallel degree between the cartridge unit and the feed roller in the process of assembling the image forming apparatus to prevent the skew of the sheet.

16 Claims, 7 Drawing Sheets

REGISTRATION DEVICE AND IMAGE FORMING APPARATUS WITH THE SAME

CROSS-REFERENCE TO RELATED APPLICATIONS

This application claims the benefit under 35 U.S.C. § 119 (a) of Korean Patent Application No. 10-2005-0028070, filed on Apr. 4, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a registration device which arranges a front end of a medium entering an image forming apparatus, and the image forming apparatus having the same.

2. Description of the Related Art

FIG. 1 is a view illustrating a sheet arranging process of a conventional image forming apparatus.

Referring to FIG. 1, a sheet P is picked up from a stacking portion 5 by a pickup roller 1 and fed to a feed roller 3. The feed roller 3 feeds the sheet P in accordance with a printing speed of an image forming unit 4. While conveying the sheet P from the stacking portion 5 to the feed roller 3, the sheet P may skew. The skew of the sheet P may worsen if a parallel arrangement between the feed roller 3 and the image forming unit 4 is changed upon assembly of the image forming apparatus.

In order to print a good quality image, an arranging process for straightening out the skew of the sheet P is carried out. An arranging process in a conventional image forming apparatus will now be described in brief with reference to FIG. 1. While the sheet P is conveyed from the stacking portion 5 to the feed roller 3, the feed roller 3 rotates in a reverse direction to a conveying direction of the sheet P. Then, although a front end of the sheet P reaches the feed roller 3, the sheet P is blocked by the feed roller 3 and is not conveyed. In this state, if the pickup roller 1 further rotates, the sheet S bends as shown by a dotted line in FIG. 1, so that the front end of the sheet P is arranged at the feed roller 3. Then, the feed roller 3 is forwardly rotated to convey the sheet P to the image forming unit 4.

The conventional apparatus has the following problems. First, if the parallel relationship between the feed roller 3 and the image forming unit 4 changes when assembling the image forming apparatus, the feed roller 3 is reversely rotated to arrange the sheet P, thereby requiring more time to arrange the sheet and thus hindering high speed printing. Second, if the parallel relationship between the feed roller 3 and the image forming unit 4 changes when assembling the apparatus, the skew of the sheet P becomes worse. The front end of the sheet P is damaged during the reverse rotation of the feed roller 3, so paper jams may result. Third, it is very difficult to reversely rotate, stop, and again forwardly rotate the feed roller 3 to arrange the sheet, due to inertia of the feed roller 3. A load is applied to a motor (not shown) for driving the feed roller 3.

In addition, as the printing speed of the image forming apparatus increases, it becomes more difficult to forwardly or reversely rotate the feed roller 3. In this case, the rotational speed of the feed roller 3, which is reversely rotated, gradually decreases and the feed roller 3 stops rotating. Then, the feed roller 3 is again forwardly rotated, and the rotational speed of the feed roller 3 is gradually increased. Although such deceleration and acceleration processes may be adopted, the printing speed of the image forming apparatus decreases due to the time required by the deceleration and acceleration process. Finally, when the sheet is printed at high speed, there is no time to arrange the sheet P by forwardly or reversely rotating the feed roller 3.

Accordingly, there is a need for a registration device configured to improve high-speed operations of the image forming apparatus.

SUMMARY OF THE INVENTION

An aspect of the present invention is to address at least the above problems and/or disadvantages and to provide at least the advantages described below. Accordingly, an aspect of the present invention is to provide a registration device capable of facilitating high-speed operations of the image forming apparatus, and an image forming apparatus with the same.

According to an aspect of the present invention, there is provided a registration device comprising a feed roller which presses one surface of a sheet to feed the sheet. A cartridge unit is placed opposite to the feed roller and includes a follower roller to support the other surface of the sheet and an image forming unit. The image forming unit forms an image on the sheet and a regulating element rotates the cartridge unit relative to the feed roller so that an arranged sheet can be fed into the image forming unit.

The registration device may further comprise a bracket interposed between the cartridge unit and the sheet to be conveyed and fixed to a body of an image forming apparatus. The cartridge unit may be rotatably coupled to the bracket.

The cartridge unit may also be coupled to the bracket so that the bracket rotates around one point.

The regulating element may comprise a regulating member which includes a rotary portion rotatably installed to the bracket and an interfering portion which extends from the rotary portion to the cartridge unit. The interfering portion interferes with one side of the cartridge unit when the rotary portion rotates to rotate the cartridge unit in a desired direction relative to the bracket.

The registration device may further include a sensor installed on the cartridge unit to detect a skew of the conveying paper.

The interfering portion may be eccentric from the rotary portion.

The rotary portion and interfering portion may be formed in a shape of a substantially circular column, and the interfering portion may be formed with a regulating groove to rotate the regulating member.

The regulating element may further comprise a drive source to forwardly or reversely rotate the regulating member, and a controller which controls the drive source based on information detected by the sensor.

According to another aspect of the present invention, there is provided an image forming apparatus having a registration device, the registration device comprising a feed roller which presses one surface of a sheet to feed the sheet. A cartridge unit may be placed opposite to the feed roller. The cartridge unit includes a follower roller to support the other surface of the sheet and an image forming unit forms an image on the sheet. A regulating element rotates the cartridge unit relative to the feed roller so that an arranged sheet can be fed into the image forming unit.

The registration device may further comprise a bracket interposed between the cartridge unit and the sheet to be conveyed and is fixed to a body of an image forming apparatus. The cartridge unit is rotatably coupled to the bracket.

The cartridge unit may be coupled to the bracket so that the bracket rotates around one point.

The regulating element may comprise a regulating member including a rotary portion rotatably installed to the bracket, and an interfering portion which extends from the rotary portion to the cartridge unit. The interfering portion interferes with one side of the cartridge unit when the rotary portion rotates to rotate the cartridge unit in a desired direction relative to the bracket.

The registration device may further include a sensor installed on the cartridge unit to detect a skew of the conveying paper.

The interfering portion may be eccentric from the rotary portion.

The rotary portion and interfering portion may be formed in a shape of a substantially circular column, and the interfering portion may be formed with a regulating groove to rotate the regulating member.

The regulating element may further comprise a drive source to forwardly or reversely rotate the regulating member. A controller may control the drive source based on information detected by the sensor.

The image forming unit may be a shuttle type inkjet head to print an image on the paper by ejecting ink onto the paper while the head is moved in a direction perpendicular to a conveying direction of the paper.

The image forming unit may be a line printing type of an inkjet head having a nozzle portion of a length corresponding to a width of paper.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

An exemplary inkjet printer including a line printing type of inkjet head comprising a nozzle portion of a length corresponding to a width of paper will be described hereinafter, however, the embodiments of the present invention are not limited thereto, and any suitable inkjet printer may be used. For example, a registration device according to the an embodiment of the present invention may be applied to an inkjet printer including a shuttle type inkjet head to print an image on the paper by ejecting ink onto the paper while the head is moved in a direction perpendicular to a conveying direction of the paper, or to electrophotographic image forming apparatuses which form a toner image by supplying toner to a photosensitive conductor on which an electrostatic latent image is formed.

Figure 1:
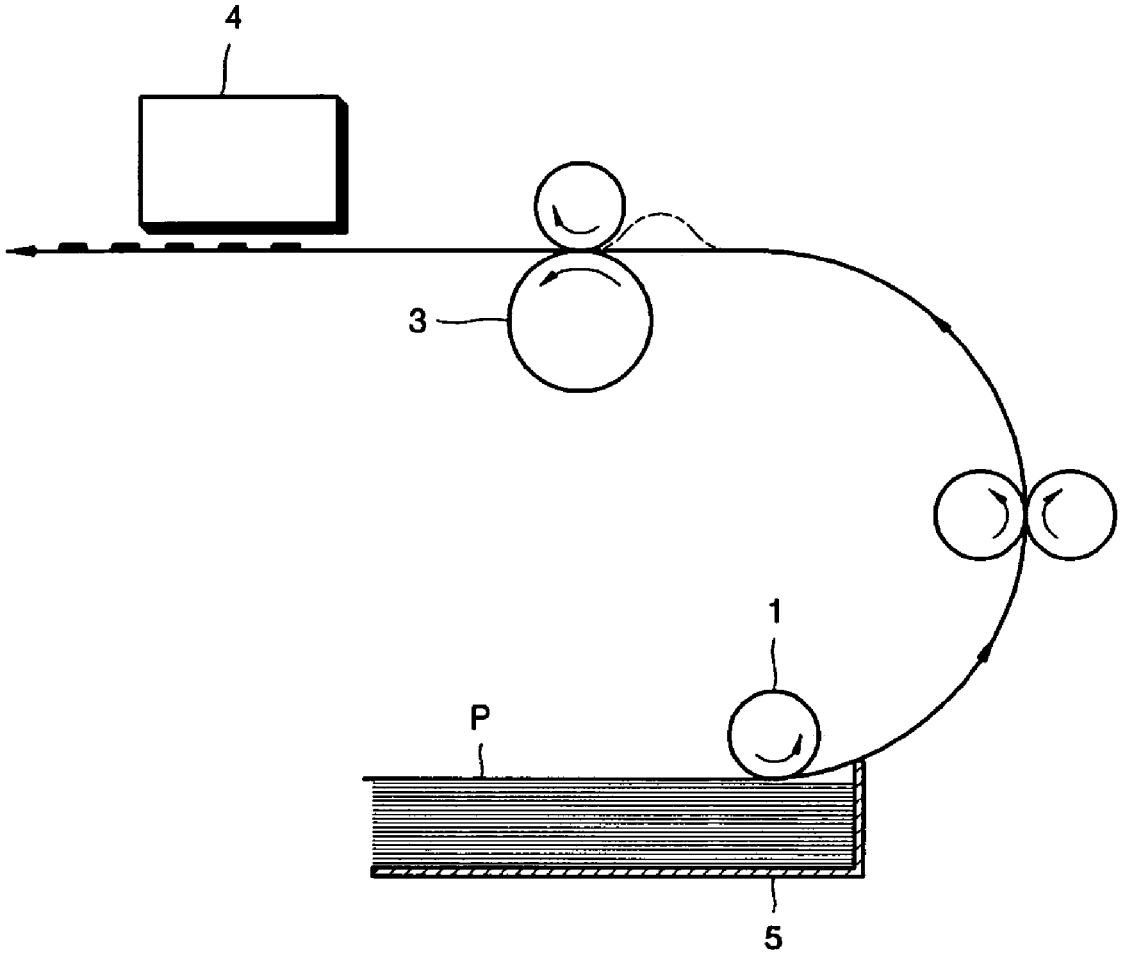
FIG. 1 (PRIOR ART)
FIG. 1 is a view illustrating a process of arranging a sheet in a conventional image forming apparatus.
Figure 2:
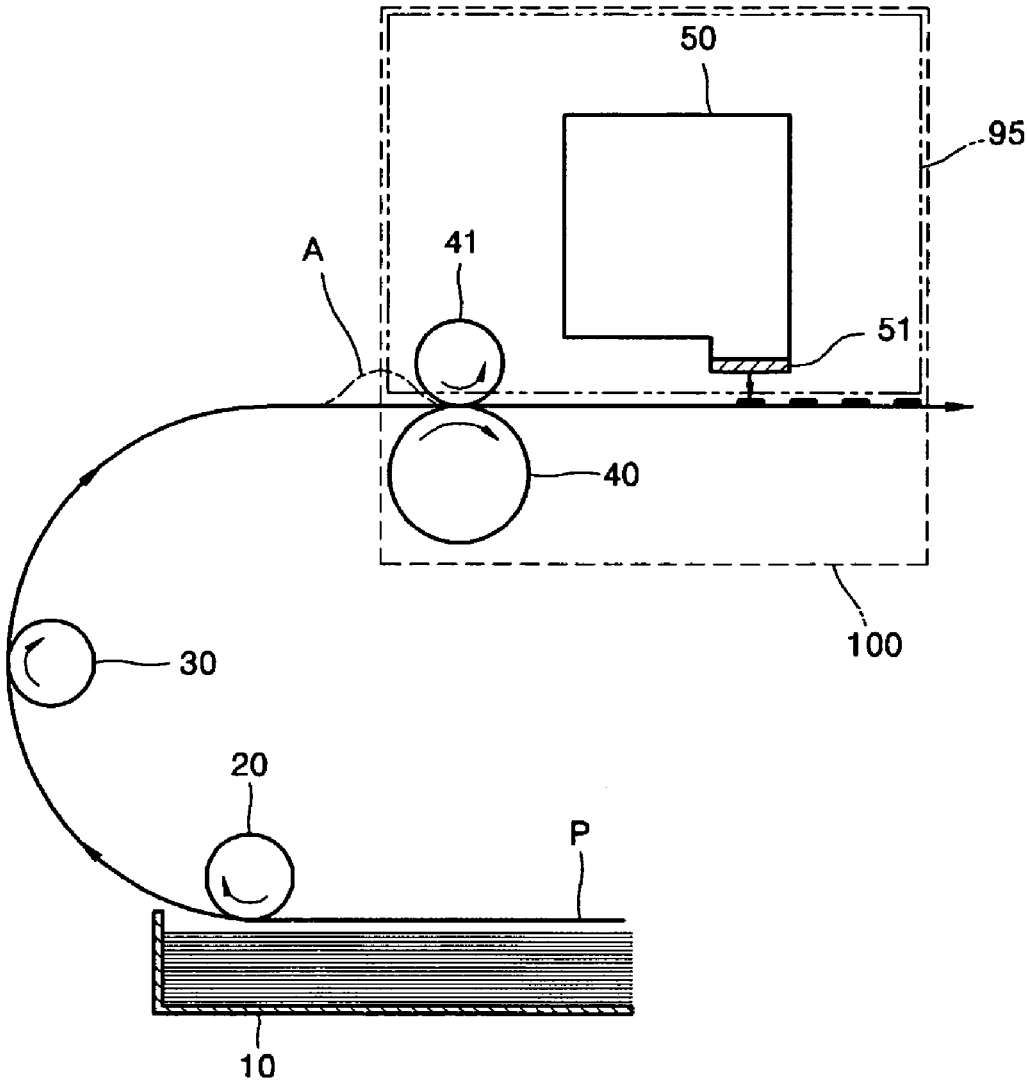
FIG. 2 is a schematic view illustrating an image forming apparatus according to an embodiment of the present invention.

FIG. 2 is a schematic view illustrating an image forming apparatus according to an exemplary embodiment of the present invention.

Referring to FIG. 2, the image forming apparatus includes a stacking portion 10 for loading sheets of paper P, a pickup roller 20 for picking up the sheets P from the stacking portion 10 one at a time, and a registration device 100 for preventing a skew of a front end of a sheet P fed from the pickup roller 20. The registration device 100 will be described in detail hereinafter. The image forming apparatus in this embodiment further includes a drive roller 30 disposed between the pickup roller 20 and a feed roller 40 for conveying the sheets P. An image forming unit 50 in the exemplary embodiment is a line printing type inkjet head having a nozzle portion 51 with a length corresponding to a width of the sheet P. Alternatively, it is possible to employ a shuttle type inkjet head to form an image by ejecting an ink droplet onto the sheet P using the nozzle portion 51 provided under the inkjet head while reciprocating in a direction perpendicular to a conveying direction of the sheet P or any other suitable apparatus.

Since the sheet P must be arranged before it is conveyed to the image forming unit 50, the image forming apparatus has to include an additional device for arranging the sheet P. The image forming apparatus of the exemplary embodiments of the present invention includes a registration unit for arranging the sheet P being conveyed. For example, the drive roller 30 or the feed roller 40 may be utilized as a registration roller to arrange the sheet P. Alternatively, although not shown in the drawings, an additional roller may be installed between the pickup roller 20 and the image forming unit 50 to serve as the register roller. In this embodiment, the drive roller 30 is used as the registration roller.

Figure 3:
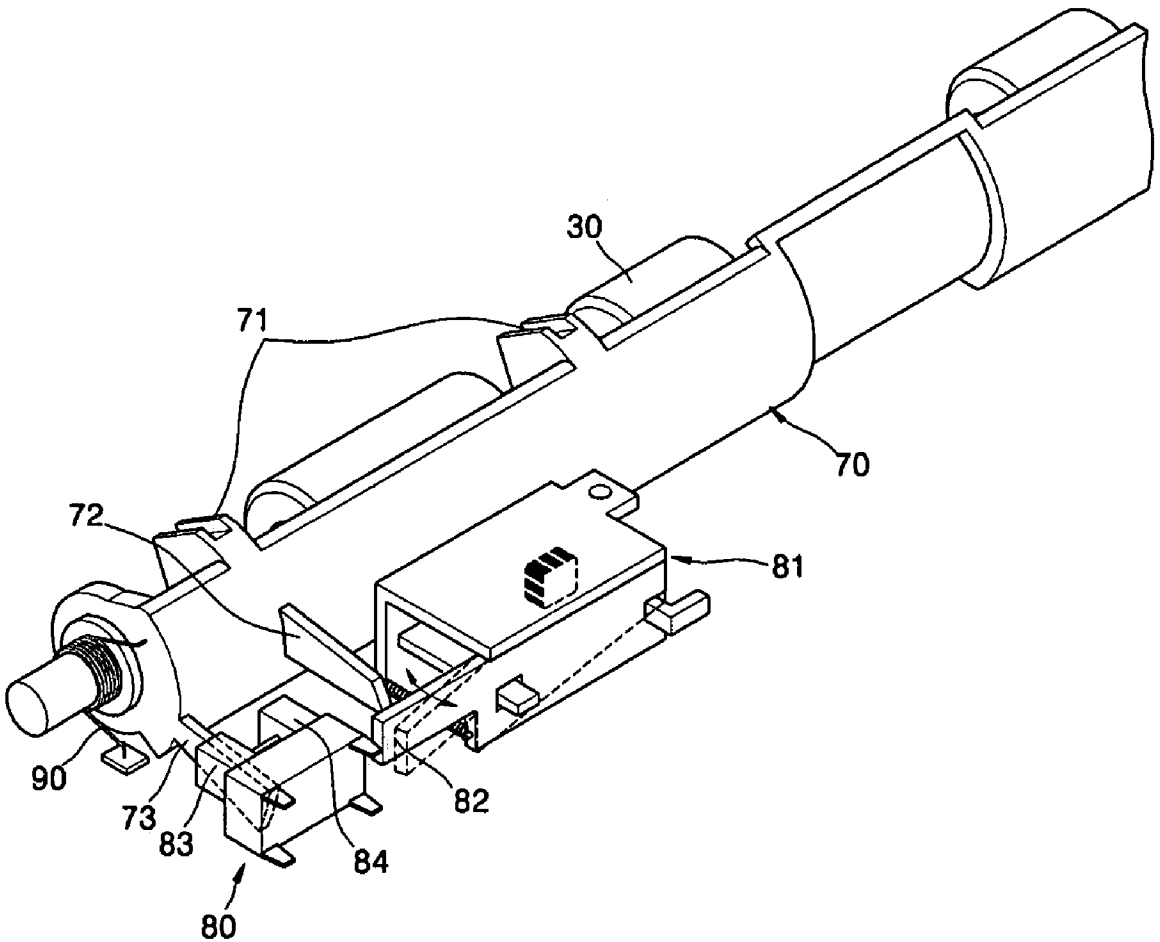
FIG.3 is a perspective view illustrating a registration unit according to an embodiment of the prevent invention.

FIG. 3 is a perspective view illustrating a registration unit according to an embodiment of the prevent invention.

Referring to FIG. 3, the registration unit includes the drive roller 30, a registration lever 70 reciprocating between an arranging position for arranging the front end of the sheet and an open position for allowing conveyance of the sheet, a solenoid 81 which is an example of an actuator capable of selectively allowing the registration lever 70 to move toward the open position, and a sensor 80. The registration lever 70 is rotatably coupled to the drive roller 30. The registration lever 70 has a contact portion 71, an interfering portion 72, and a sensor arm 73. The contact portion 71 contacts the front end of the sheet P fed to the drive roller 30. The interfering portion 72 interferes with an arm 82 of the solenoid 81, and the registration lever 70 is selectively rotated toward the open position according to whether the interfering portion 72 interferes with the arm 82. The sensor 80 detects a position of the sensor arm 73 to determine whether the registration lever 70 is in an arranging position. Preferably, as shown in FIG. 2, the sensor 80 is an optical sensor having a light emitting portion 83 and a light receiving portion 84. For example, when the registration lever 70 is in an initial position, the sensor arm 73 is located between the light emitting portion 83 and the light receiving portion 84 to intercept a path of light from the light emitting portion 83 to the light receiving portion 84.

The operation of the registration unit configured as described above will now be described in brief. In order to arrange a skewed sheet P, the contact portion 71 blocks the sheet P before the front end of the sheet is led to the drive roller 30. When the front end of the sheet S contacts the contact portion 71, the registration lever 70 is pushed by the sheet P, and is thus slightly rotated toward an open position (not shown). At this time, the sensor arm 73 is located between the light emitting portion 83 and the light receiving portion 84 to intercept a path of light. Since the light is intercepted by the sensor arm 73, a signal output from the light receiving portion 84 is input to a controller (not shown), and the controller determines whether the registration lever 70 is in the arranging position. At this time, the interfering portion 72 contacts the arm 82 of the solenoid 81. Therefore, the interfering portion 72 is not rotated. Although the front end of the sheet P, skewed due to further rotation of the pickup roller 20, pushes the contact portion of the registration lever 70, the sheet P does not rotate. Instead, the sheet P is slightly bent by the rigidity of the front end of the sheet P having previously reached the contact portion 71, as shown by a dotted line 'A' in FIG. 2. Then, the sheet P is continuously conveyed until a rear end of the sheet P contacts the contact portion 71. With the above process, while the sheet P is arranged against the contact portion 71, the arm 82 of the solenoid 81 comes into contact with the interfering portion 72, so that the rotation of the registration lever 70 to the open position is prevented. If the arrangement is completed, an electric current is supplied to the solenoid 81, and the arm 82 is free from the interfering portion 72, as shown by a dotted line in FIG. 3. As the pickup roller 20 continuously rotates and the sheet P pushes the contact portion 71, the registration lever 70 is rotated toward the open position. Hence the sheet P, which is completely arranged, is fed between the feed roller 40 and a follower roller 41, and the image forming unit 50 ejects ink onto the sheet P form an image. A torsion spring 90 returns the registration lever 70 to its initial position using a resilient restoring force.

When a cartridge unit 95 is assembled into the image forming apparatus and then the sheet P is printed, the sheet P having the front end is arranged by the registration unit and is conveyed to the image forming unit 50. If the cartridge unit 95 and the feed roller 40 are assembled at an incline with respect to each other, the cartridge unit 95 and the feed roller 40 are assembled in an unaligned state, the skew of the sheet P has to be corrected whenever the sheet P is conveyed, thereby lowering the printing speed. Consequently, it is relatively important to correct the positions of the feed roller 40 and the cartridge unit 95 when the cartridge unit 95 is assembled or replaced. For example, when the image forming unit 50 is replaced. In other words, it is relatively important to determine the relative position between the cartridge unit 95 and the feed roller 40 so as to prevent the skew of the sheet P fed into the image forming unit 50.

The registration device 100 is used to prevent the front end of the sheet P from being skewed, and includes the feed roller 40, the cartridge unit 95 placed opposite to the feed roller 40, and a regulating element 120 (see FIG. 4) to rotate the cartridge 95 relative to the feed roller 40.

The feed roller 40 presses one surface of the sheet P to feed the sheet P to the image forming unit 50.

The cartridge unit 95 is placed on a side of the sheet P opposite to the side where the feed roller 40 is located, and includes the follower roller 41 for supporting the surface of the sheet P other than the surface of the sheet P supported by the feed roller 40, and the image forming unit 50 for forming an image on the sheet P. As described above, the image forming unit 50 includes the nozzle portion 51 with a length corresponding to the width of the sheet P. The nozzle portion 51 ejects ink onto the sheet P to form the image on the sheet.

The follower roller 41 presses down on the feed roller 40 with a predetermined pressure and rotates to convey the sheet P passing therebetween. The image forming unit 50 further includes a chamber (not shown) communicating with the respective orifices of the nozzle portion 51 and including an ejecting element (not shown) for applying pressure to eject ink. For example, such as a piezoelectric device or a heater, and a passage (not shown) for supplying the ink contained in the image forming unit 50 to the chamber. The chamber, the ejecting element, and the passage are widely known in those skilled in the art, so a detailed description thereof will be omitted herein for clarity and conciseness.

Figure 4:
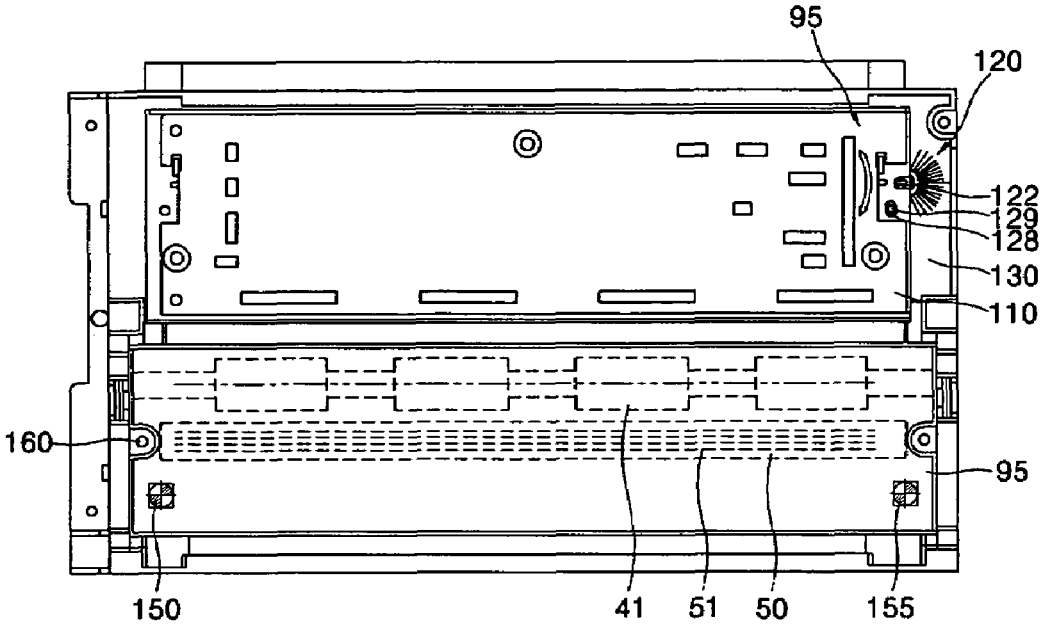
FIG. 4 is a top view illustrating a registration device included in the image forming apparatus according to the embodiment of the prevent invention illustrated in FIG. 2.
Figure 5:
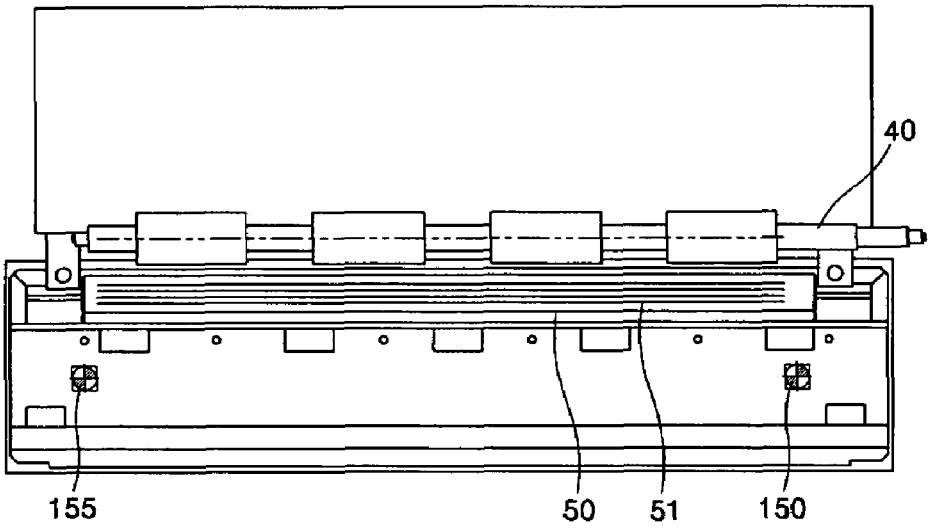
FIG. 5 is a bottom view illustrating the registration device of FIG. 4.

FIG. 4 is a top view illustrating the registration device 100, and FIG. 5 is a bottom view illustrating the registration device 100.

Referring to FIGS. 4 and 5, the cartridge unit 95 includes a frame 110 on which the image forming unit 50 and the follower roller 41 are installed. The image forming unit 50 and the follower roller 41 are assembled onto the frame 110, which is installed on a body of the image forming apparatus and restricted by a movement of the frame 110 during an interference of a regulating member 122, to be thus rotated together with the frame 110.

A bracket 130 is interposed between the cartridge unit 95 and the sheet to be conveyed. The bracket 130 is fixed to the body of the image forming apparatus. The cartridge 95, and more specifically the frame 110, is rotatably coupled to the bracket 130. As shown in FIG. 4, the frame 110 is coupled to the bracket 130 so as to rotate around one point 160. In other words, the cartridge 95 is hinged to the bracket 130 by the point 160, and is rotated in parallel with the conveying direction of the sheet by the regulating element 120.

When assembling the cartridge unit 95 and the feed roller 40, it is important to arrange the nozzle portion 51 and the feed roller 40 of the cartridge unit 95 parallel with each other so as to prevent the skew of the sheet P. Specifically, it is important that the cartridge unit 95 is assembled or replaced in consideration of parallelism between the nozzle portion 51 and the feed roller 40, so as to prevent the skew of the sheet P.

The regulating element 120 rotates the cartridge unit 95 relative to the feed roller 4. Consequently, the arranged front end of the sheet P can be fed into the image forming unit 50. In other words, the regulating element 120 interferes with one side of the cartridge 95 to make the nozzle portion 51 and the feed roller 40 parallel with each other. The regulating element 120 automatically or manually rotates the cartridge unit 95. In one embodiment, the regulating element 120 has the regulating member 122 rotatably installed on the bracket 130 and interferes with the cartridge unit 95 upon rotation. Therefore, the cartridge unit 95 is rotated.

Figure 6:
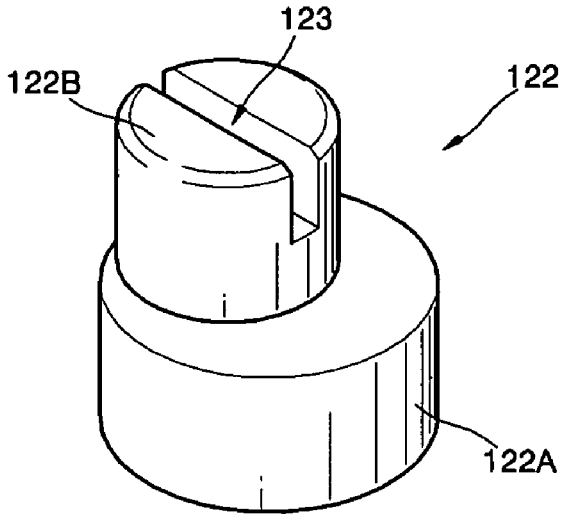
FIG. 6 is a perspective view illustrating a regulating element included in the registration device illustrated in FIGS. 4 and 5.

FIG. 6 is a perspective view illustrating the regulating member 122. Referring to FIG. 6, the regulating member 122 has a rotary portion 122A rotatably installed on the bracket 130, and a regulating member interfering portion 122B extending from the rotary portion 122A to the cartridge 95. Preferably, the rotary portion 122A is formed in the shape of a substantially circular column so that the rotary portion 122A can be inserted into an engaging hole (not shown) provided on the bracket 130 to rotate freely. Preferably, the regulating member interfering portion 122B is formed to be eccentric from the rotary portion 122A so that the rotary portion 122A can interfere with one side of the cartridge unit 95 upon rotation. This is turn rotates the cartridge unit 95 to the bracket 130 in a desired direction with respect to the bracket 130. Preferably, the regulating member interfering portion 122B is also formed in the shape of a substantially circular column; however, other suitable shapes may be used. For example, the regulating member interfering portion 122B may be formed in the shape of an oval column, such as a cam. The regulating member interfering portion 122B has at one side a regulating groove 123 for rotating the regulating member 122 in a desired direction.

Figure 7:
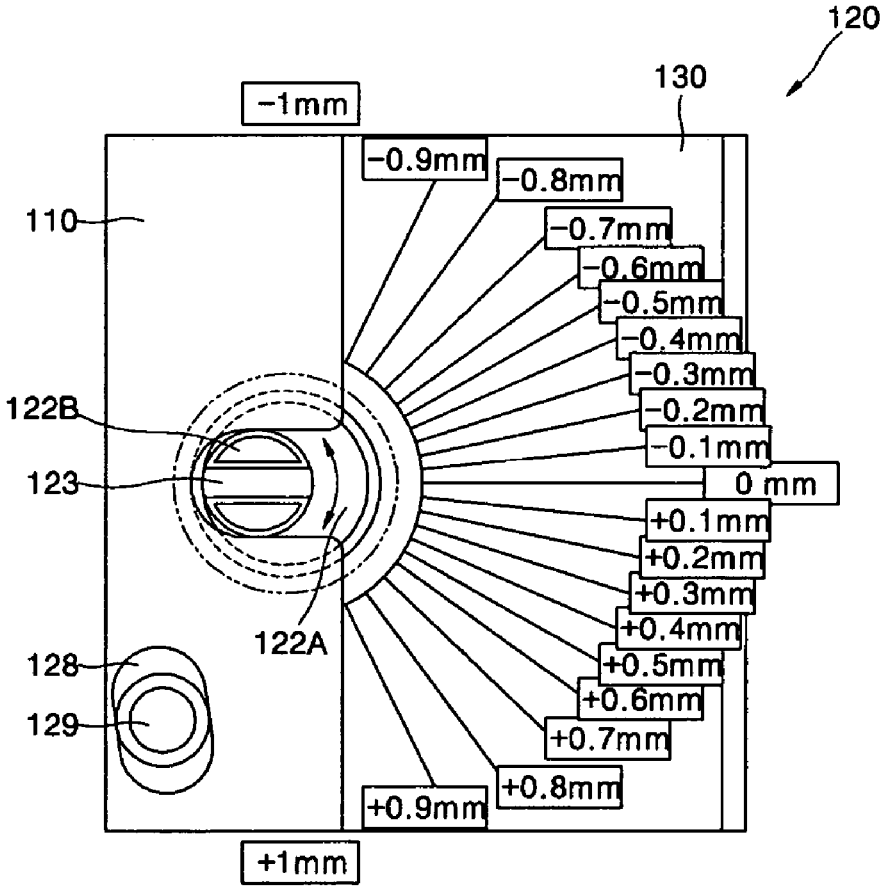
FIG. 7 is a view illustrating a regulating element included in the registration device illustrated in FIGS. 4 and 5.
Figure 8A:
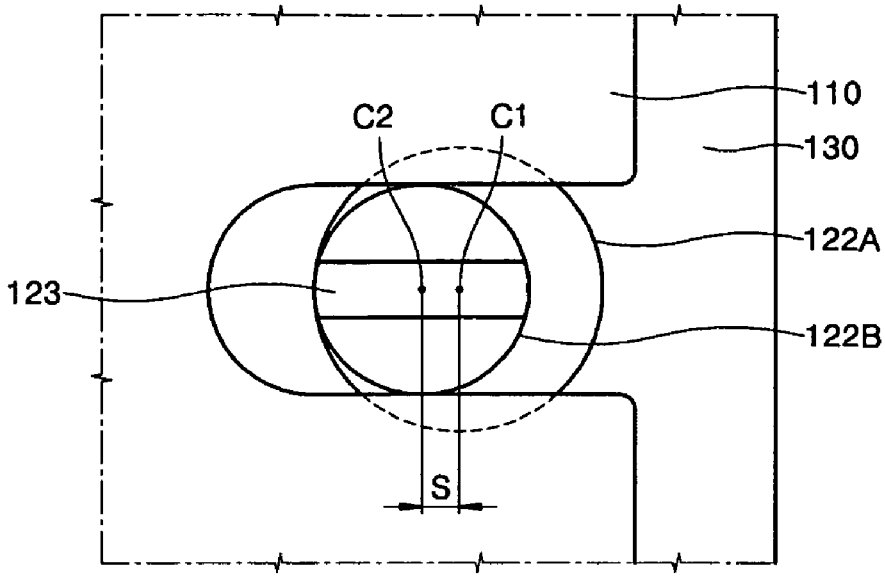
FIGS. 8A and 8B are views illustrating an operation of rotating a cartridge unit using the regulating member according to an embodiment of the present invention.
Figure 8B:
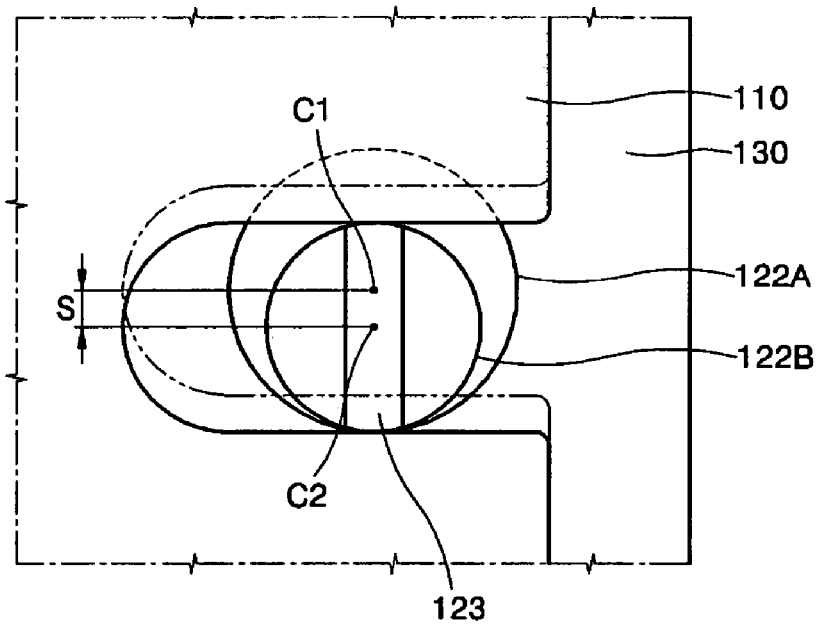

FIG. 7 is a view illustrating the regulating element 120, and FIGS. 8A and 8B are views illustrating the operation of rotating the cartridge unit 95 using the regulating element 120. Referring to FIGS. 4 and 7, indicia showing rotational amounts of the cartridge unit 95, for example, rotational displacements of the frame 110, depending on the rotation of the regulating member 122 are indicated on the bracket 130. Since the rotary portion 122A of the regulating member 122 is rotated in a stationary state, the regulating member interfering portion 122B, eccentrically formed with respect to the rotary portion 122A, is rotated due to a rotation of the regulating groove 123. The regulating member interfering portion 122B interferes with one side of the frame 110. Hence, the frame 110 is rotated around the hinge 160 in a desired direction. After the nozzle portion 51 and the feed roller 40 of the cartridge unit 95 are made parallel by rotating the regulating member 122, the frame 110 is fixed to the bracket 130 by using a fixing member 129. The frame 110 is formed with a fixing groove 128 which is longitudinally elongated to allow the frame 110 to rotate. A rotation of the frame 110 shown in FIGS. 8A and 8B, that is, a rotation of the cartridge unit 95 will be described in detail hereinafter.

Figure 9:
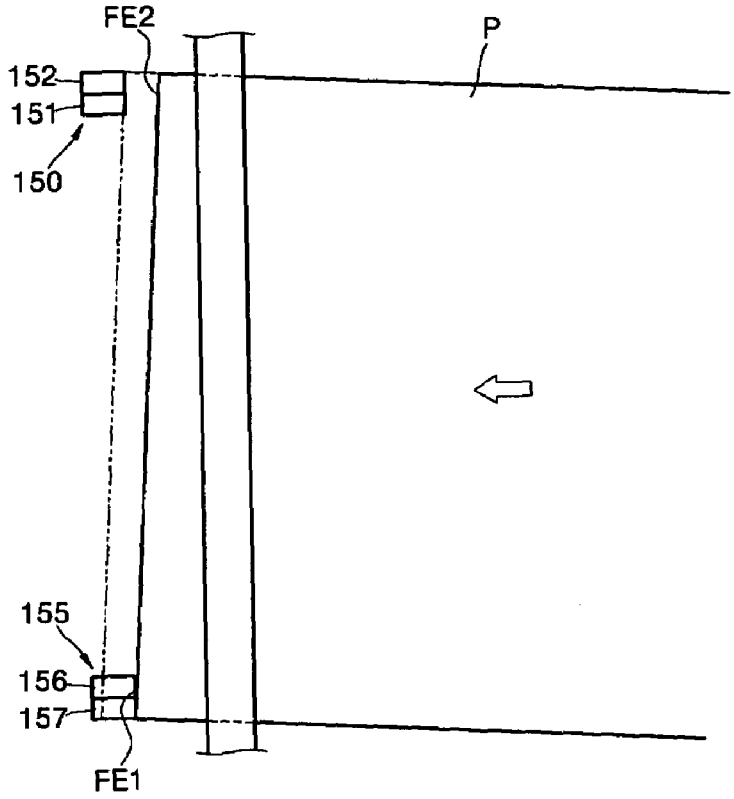
FIG. 9 is a view illustrating constructions and operations of sensors according to an embodiment of the present invention.

FIG. 9 is a view illustrating constructions and operations of sensors 150 and 155. The sensors 150 and 155 are installed on the cartridge unit 95 to detect the front end of the conveying sheet P to detect the skew of the sheet P. In an exemplary embodiment, the sensors 150 and 155 can detect the skew of the sheet P by using an actuator (not shown) formed on a path of both front ends FE1 and FE2 of the conveying sheet P. Specifically, both front ends FE1 and FE2 interfere with the actuator while the sheet P is being conveyed. At this time, if the sheet P is skewed, points of time when both front ends FE1 and FE2 interfere with the actuator are different from each other, and the skew of the sheet P can be detected using the time difference. Alternatively, the skew of the sheet P can be detected using an amount of transmitted light or reflected light resulting from irradiating the light onto the front ends FE1 and FE2 of the conveying sheet P. In the process of detecting the skew of the sheet P using the amount of transmitted light, a light emitting portion is installed on one side of the sheet P, and a light receiving portion is installed opposite on the other side of the sheet P. Therefore, the amount of the light incident upon the light receiving portion is measured to detect the skew of the sheet. In this embodiment, a method of detecting the skew of the sheet P using a light-reflective photosensor which detects the amount of the reflected light is illustrated as an example. This case does not limit the scope of the exemplary embodiments of the present invention and other suitable arrangements may be used.

Referring to FIG. 9, the sensors 150 and 155 are installed on both ends of the sheet S in the width direction of the sheet P to irradiate light onto the sheet P. In other words, the sensors 150 and 155 detect the difference of time points when both ends FE1 and FE2 of the conveying sheet P enter, thereby detecting the skew of the sheet P. The sensors 150 and 155 have light emitting portions 151 and 156, respectively, for emitting the light onto the conveying sheet P, and light receiving portions 152 and 157, respectively, for receiving the reflected light. As shown in FIG. 9, one front end FE1 of the sheet P conveying in an arrow direction enters the sensor 155. As one front end FE1 of the sheet P enters the sensor 155, there is a difference in the amounts of the light received by the light receiving portion 157. The sensor 155 detects the difference, thereby detecting the time when one front end FE1 of the sheet P enters the sensor 155. After lapse of a given time, the other front end FE2 of the sheet P enters the sensor 150. The sensor 150 detects the time when the front end FE2 of the sheet P enters the sensor 150 through the same process as described above. The sensors 150 and 155 can measure a skew degree of sheet P by calculating the difference between the time when the one front end FE1 of the sheet P enters the sensor 155 and the time when the other front end FE2 of the sheet P enters into the sensor 150. It is therefore possible to automatically adjust the cartridge unit 95 using information detected by the sensors 150 and 155. The sensors 150 and 155 are placed next to the image forming unit 50 in this embodiment; however, the disposition of the sensors 150 and 155 can be arranged in other suitable configurations. For example, the sensors 150 and 155 may be placed ahead of the feed roller 40.

Figure 10:
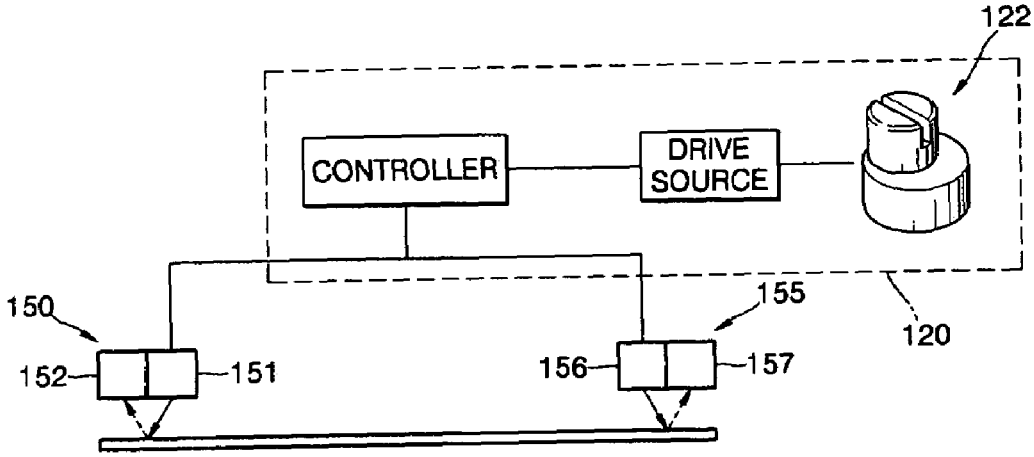
FIG. 10 is a view illustrating a process of automatically regulating the cartridge unit according to an embodiment of the present invention.

FIG. 10 is a view illustrating a process of automatically regulating the cartridge unit. Referring to FIG. 10, the regulating element 120 further includes a drive source, and a controller, which are not numbered. The drive source transmits a drive force to one side of the regulating member 122 to forwardly or reversely rotate the regulating member 122. The controller controls the drive source based on the information detected by the sensors 150 and 155 to control the movement of the regulating member 122. Specifically, the controller rotates the regulating member 122 in a desired direction so as to compensate for an arranging error detected by the sensors 150 and 155. The regulating member 122 interferes with the cartridge unit 95, for example, on one side of the frame 110 to place the cartridge unit 95 and the feed roller 40 parallel to each other.

A method of arranging the cartridge unit 95 and the feed roller 40 using the registration device 100 configured as described above will now be described.

After one of the sheets P stacked on the stacking portion 10 is picked up by the pickup roller 20, the skew degree of the sheet P is checked by the sensors 150 and 155. If the skew degree of the sheet P detected by the sensors 150 and 155 is within an allowable error range, correction is not necessary. If the skew degree is out of the allowable error range, it must be compensated. The skew degree of the sheet P may be detected by the method as described above. Alternatively, the skew degree of the sheet P may be detected by ejecting ink onto the conveying sheet P and printing an image on the sheet. Also, a user may be notified of the skew degree of the sheet P through a display (not shown).

If the sheet P is skewed, it must be compensated. Examples of a method of compensating the skew include a method of manually rotating the regulating member 122 by a user, and a method of automatically rotating the regulating member 122 using the drive source which is controlled by the controller based on the information detected by the sensors 150 and 155. In the method of manually rotating the regulating member 122, the cartridge unit 95 and the frame 110 rotate around the hinge 160 by rotating the regulating member 122 in an arrow direction as shown in FIGS. 4 and 7. In the method of automatically rotating the regulating member 122, the regulating member 122 is rotated by a distorted amount by using a drive source such as a motor.

When the regulating member 122 is rotated as described above, one side of the regulating member 122 interferes with the cartridge unit 95 to rotate the frame 110. Referring to FIGS. 8A and 8B, the operation will now be described. Referring to FIG. 8A, C1 indicates a center of the rotary portion 122A, and C2 indicates a center of the interfering portion 122B. Also, S indicates a distance between C1 and C2, that is, an eccentric degree at which the interfering portion 122B is eccentric from the rotary portion 122A. If the regulating member 122 shown in FIG. 8A is rotated by 90 degrees counterclockwise (CCW), the regulating member 122 is rotated as shown in FIG. 8B. The dotted line in FIG. 8B indicates a position of the cartridge unit 95 which is not yet moved. As shown in FIG. 8B, if the regulating member 122 is rotated circularly, the rotary portion 122A rotates around C1 in the bracket 130. At this time, since a small circle of the interfering portion 122B is eccentric from the rotary portion 122A, the center C2 of the interfering portion 122B circulates around C1 as a reference point. Accordingly, the outer side of the interfering portion 122B interferes with the cartridge portion 95 so that the frame 110 is rotated around the hinge 160 (FIG. 4). The error is compensated for through the above process. After compensating for the error, a next sheet P is picked up, and it is determined whether the skew of the sheet is properly compensated. If the compensation is properly performed, the cartridge unit 95 is fixed to the bracket 130 using the fixing member 129. If not, the above process is repeated to properly compensate for the error.

With the above construction, the exemplary embodiments of the present invention can dispose the cartridge unit 95 at a proper location to prevent the skew of the sheet P fed into the image forming unit 50 when the cartridge unit 95 is assembled or replaced.

As described above, a registration device of the exemplary embodiments of the present invention can regulate the parallel degree between a cartridge unit and a feed roller during assembly of an image forming apparatus to thereby prevent the sheet from skewing. In addition, due to the prevention of the skew of the sheet, the image forming apparatus can operate at high speeds.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A registration device for use with an image forming unit, said registration device comprising:

a feed roller which presses one surface of a sheet to feed the sheet;

a cartridge unit placed opposite to the feed roller; and a rotatably displaceable regulating element being selectively rotatable for responsive rotation of the cartridge unit relative to the feed roller whereby the sheet is disposed to be arranged and fed into the image forming unit which forms an image on the sheet, wherein the cartridge unit includes a follower roller to support the other surface of the sheet.

2. The registration device according to claim 1, further comprising a bracket interposed between the cartridge unit and the sheet to be conveyed, and fixed to a body of the image forming apparatus, wherein the cartridge unit is rotatably coupled to the bracket.

3. The registration device according to claim 2, wherein the cartridge unit is coupled to the bracket so that the cartridge unit rotates around one point.

4. The registration device according to claim 2, wherein the regulating element comprises a regulating member including a rotary portion rotatably installed to the bracket, and an interfering portion extending from the rotary portion to the cartridge unit, the interfering portion interfering with one side of the cartridge unit when the rotary portion rotates, thereby rotating the cartridge unit in a desired direction relative to the bracket.

5. The registration device according to claim 4, further comprising a sensor installed on the cartridge unit which detects a skew of the sheet.

6. The registration device according to claim 5, wherein the interfering portion is eccentric from the rotary portion.

7. The registration device according to claim 6, wherein the rotary portion and the interfering portion are formed in a shape of a substantially circular column, and the interfering portion is formed with a regulating groove which rotates the regulating member.

8. The registration device according to claim 5, wherein the regulating element further comprises:

a drive source to forwardly or reversely rotate the regulating member; and a controller which controls the drive source based on information detected by the sensor.

9. An image forming apparatus having a registration device, the registration device comprising:

a feed roller which presses one surface of a sheet to feed the sheet;

a cartridge unit placed opposite to the feed roller; and a rotatably displaceable regulating element being selectively rotatable for responsive rotation of the cartridge unit relative to the feed roller whereby the sheet is disposed to be arranged and fed into the image forming apparatus which forms an image on the sheet, wherein the cartridge unit includes a follower roller to support the other surface of the sheet.

10. The image forming apparatus according to claim 9, wherein the registration device further comprises a bracket interposed between the cartridge unit and the sheet to be conveyed, and fixed to a body of the image forming apparatus, and wherein the cartridge unit is rotatably coupled to the bracket.

11. The image forming apparatus according to claim 10, wherein the cartridge unit is coupled to the bracket so that the cartridge unit rotates around one point.

12. The image forming apparatus according to claim 9, wherein the regulating element comprises a regulating member including a rotary portion rotatably installed to the bracket, and an interfering portion extending from the rotary portion to the cartridge unit, the interfering portion interfering with one side of the cartridge unit when the rotary portion rotates, thereby rotating the cartridge unit in a desired direction relative to the bracket.

13. The image forming apparatus according to claim 12, further comprising a sensor installed on the cartridge unit which detects a skew of the sheet.

14. The image forming apparatus according to claim 13, wherein the interfering portion is eccentric from the rotary portion.

15. The image forming apparatus according to claim 14, wherein the rotary portion and the interfering portion are formed in a shape of a substantially circular column, and the interfering portion is formed with a regulating groove which rotates the regulating member.

16. The image forming apparatus according to claim 13, wherein the regulating element further comprises:

a drive source to forwardly or reversely rotate the regulating member; and a controller which controls the drive source based on information detected by the sensor.

* * * * *